US012397342B2

(12) United States Patent
Wagstaff et al.

(10) Patent No.: US 12,397,342 B2
(45) Date of Patent: Aug. 26, 2025

(54) BOTTOM BLOCK FOR DIRECT CHILL CASTING

(71) Applicant: Oculatus LLC, Greenacres, WA (US)

(72) Inventors: Robert B. Wagstaff, Greenacres, WA (US); Samuel R. Wagstaff, Marietta, GA (US); Brent M. Opdendries, Post Falls, ID (US)

(73) Assignee: Oculatus LLC, Greenacres, WA (US)

( * ) Notice: Subject to any disclaimer, the term of this patent is extended or adjusted under 35 U.S.C. 154(b) by 0 days.

(21) Appl. No.: 18/712,929

(22) PCT Filed: Nov. 22, 2022

(86) PCT No.: PCT/US2022/050760

§ 371 (c)(1),
(2) Date: May 23, 2024

(87) PCT Pub. No.: WO2023/096919

PCT Pub. Date: Jun. 1, 2023

(65) Prior Publication Data

US 2025/0018464 A1 Jan. 16, 2025

Related U.S. Application Data

(60) Provisional application No. 63/282,626, filed on Nov. 23, 2021.

(51) Int. Cl.
*B22D 11/08* (2006.01)
*B22D 11/049* (2006.01)

(52) U.S. Cl.
CPC ..... *B22D 11/049* (2013.01); *B22D 11/081* (2013.01)

(58) Field of Classification Search
CPC ..... B22D 11/08; B22D 11/081; B22D 11/083; B22D 11/085; B22D 11/086; B22D 11/088
See application file for complete search history.

(56) References Cited

U.S. PATENT DOCUMENTS

| | | | | |
|---|---|---|---|---|
| 3,593,776 | A * | 7/1971 | Williamson | B22D 11/083 164/446 |
| 4,149,582 | A * | 4/1979 | Johansson | B22D 11/083 164/483 |
| 5,947,183 | A | 9/1999 | Schneider et al. | |
| 6,056,040 | A | 5/2000 | Weaver et al. | |
| 2004/0055732 | A1 | 3/2004 | LeBlanc et al. | |
| 2010/0025003 | A1 | 2/2010 | Wagstaff et al. | |
| 2013/0248136 | A1 | 9/2013 | Fenton et al. | |
| 2015/0336168 | A1 | 11/2015 | Wagstaff et al. | |

OTHER PUBLICATIONS

PCT Invitation to Pay Fees mailed Jan. 25, 2023 for PCT application No. PCT/US2022/050760, 2 pages.
PCT Search Report and Written Opinion mailed Apr. 18, 2023 for PCT application No. PCT/US2022/050760, 12 pages.

* cited by examiner

*Primary Examiner* — Kevin E Yoon
(74) *Attorney, Agent, or Firm* — Lee & Hayes, P.C.

(57) ABSTRACT

A bottom block for use in direct chill (DC) casting that includes a flared base providing additional surface area for contact with coolant used in the DC casting process. The bottom block includes a first end that substantially fits within a DC mold while a second end has a larger cross-sectional area than the first end. A transition between the first end and the second end provides a surface for coolant to contact despite film boiling and air gaps between the ingot and the coolant.

3 Claims, 11 Drawing Sheets

BOTTOM BLOCK FOR DIRECT CHILL CASTING

RELATED APPLICATIONS

This application claims priority to U.S. Provisional Application No. 63/282,626, filed on Nov. 23, 2021, the entire contents of which is incorporated herein by reference for all purposes.

BACKGROUND

Metal ingots are commonly produced by direct chill casting of molten metals. This involves pouring a molten metal into a mold having cooled walls, an open upper end and (after start-up) an open lower end. Molten metal is introduced into the mold at the open upper end and is cooled and solidified (at least externally) as it passes through the mold. Solidified metal in the form of an ingot emerges from the open lower end of the mold and descends as the casting operation proceeds. Alternately, the casting takes place horizontally, but the procedure is essentially the same. Such casting techniques are particularly suited for the casting of aluminum and aluminum alloys but may be employed for other metals too.

BRIEF DESCRIPTION OF THE DRAWINGS

The detailed description is set forth below with reference to the accompanying figures. In the figures, the left-most digit(s) of a reference number identifies the figure in which the reference number first appears. The use of the same reference numbers in different figures indicates similar or identical items. The systems depicted in the accompanying figures are not to scale and components within the figures may be depicted not to scale with each other.

DETAILED DESCRIPTION

Figure 1:
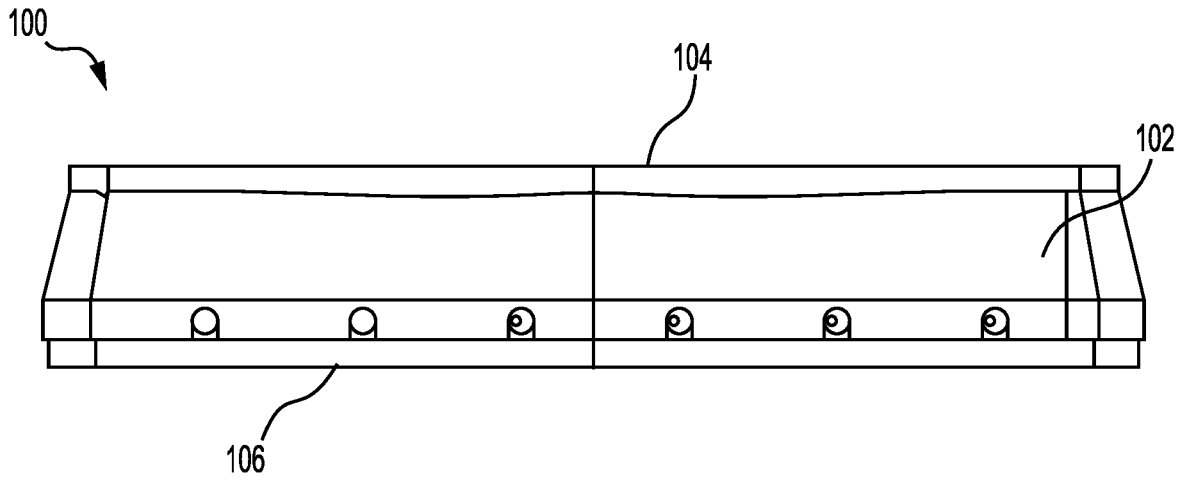
FIG. 1 illustrates a side view of a flared bottom block, according to at least one example.
Figure 2:
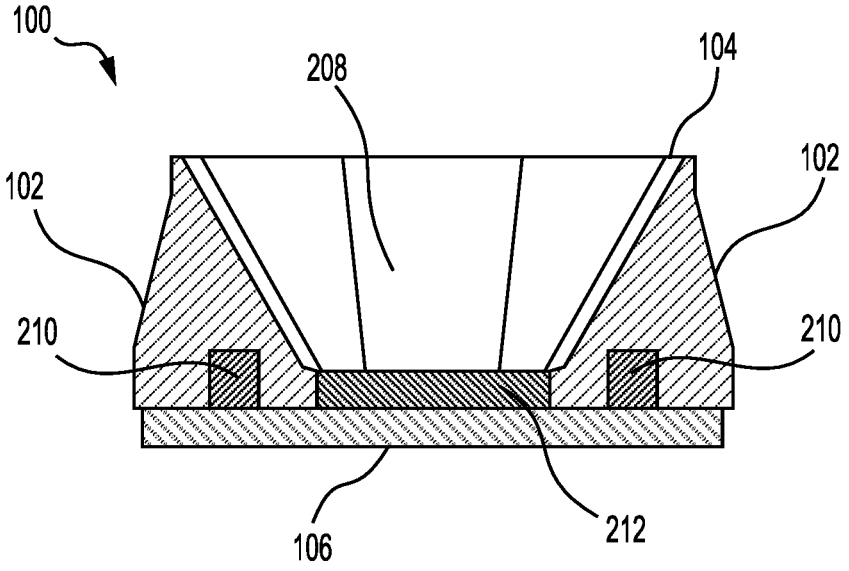
FIG. 2 illustrates a section view of the flared bottom block of FIG. 1 taken across the width of the flared bottom block, according to at least one example.
Figure 3:
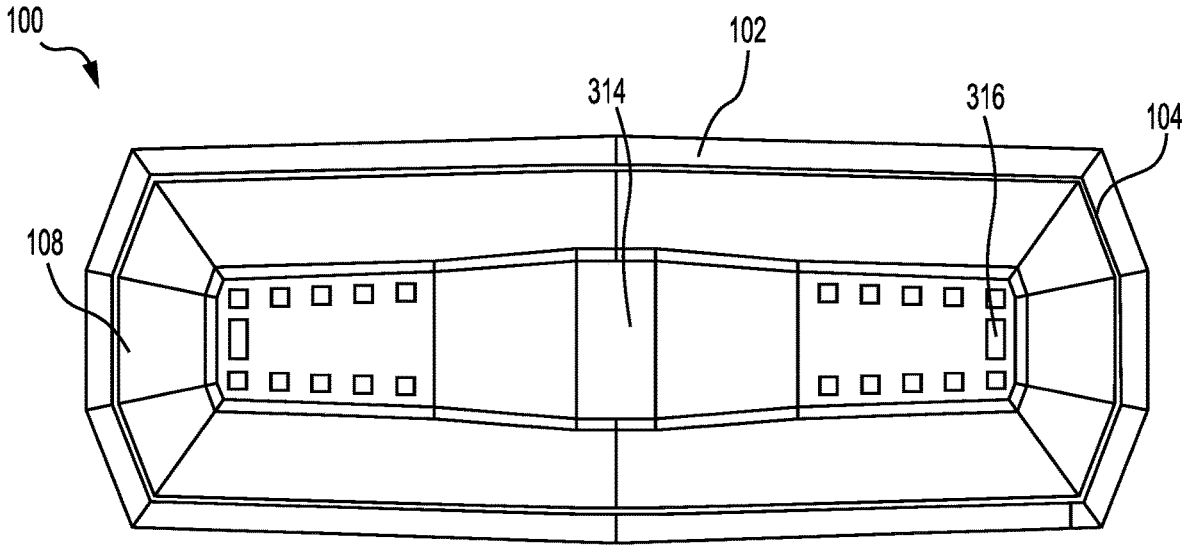
FIG. 3 illustrates a top view of the flared bottom block of FIG. 1, according to at least one example.
Figure 4:
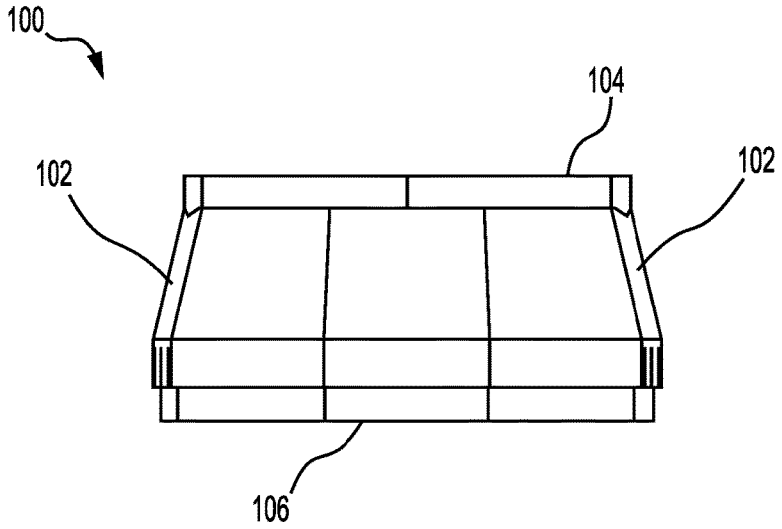
FIG. 4 illustrates an end view of the flared bottom block of FIG. 1, according to at least one example.

Systems and devices described herein are related to an improved bottom block design particularly suitable for the vertical direct chill (DC) casting of large aluminum rolling ingots, i.e., having a cross section of at least 10×20 inches. The bottom blocks include an inner cavity such that when the bottom block is brought adjacent a DC mold body a temporary mold cavity is formed that may be filled to start the cast and the bottom block may be lowered once the cavity is filled with molten metal as is known in the art. The bottom portion of the ingot is sometimes referred to as the butt or butt portion of the ingot, and it tends to be thicker, which is sometimes referred to as "butt swell." The examples described herein, which can be fabricated from aluminum or steel, may reduce butt swell and butt cracks and alligating in rolling ingots by providing thermal sinks and surface area for coolant to contact and further reduce the temperature of the bottom block and butt of the rolling ingot during casting. The example bottom blocks described herein enable contact with cooling fluid that typically bypasses the bottom block as it runs down the face of the ingot due to film boiling on the surface of the ingot that creates a barrier between the cooling liquid and the butt of the ingot and the bottom block, particularly as a DC cast progresses past an initial startup stage.

In some examples, the term bottom block may also be referred to as a starting head, dummy block, stool cap, or a starting block, all commonly used to refer to the same general components.

The bottom block designs described herein enable contact with cooling fluid, such as water, that is used in DC casting to cool a surface of the ingot. As mentioned above, due to film boiling at the surface of the ingot just after solidification, the cooling fluid typically does not run down the entire surface of the ingot and bottom block. As a result, in typical systems the bottom block becomes a source of retained heat that may keep the butt of the ingot at a higher temperature than desired and may cause increased butt swell or other adverse (distortion due to thermal differences in the block) effects. The designs herein enable additional surface contact with the cooling water as it flows downward during the cast and thereby reduces the heat stored in the bottom block, thereby reducing butt swell and other adverse effects.

In some examples, a deeper bottom block may assist in reducing or eliminating bleed-outs of the cast ingot during the casting process so that the ingot may be able to support its own form and weight by the time the bottom block emerges below the mold walls. In some examples, the bottom block allows more time for the molten metal to remain and cool within the bottom block before additional weight from additional casting is placed on that initial metal, which allows that lower part of the solidifying ingot to better support the form of the ingot as a whole via solidification. In some examples, external or internal cooling within the bottom block may assist this support.

The bottom block designs included herewith result in metal ingots that may be rolled following casting without introducing alligator splits at the end of the ingot by having a shaped end for the ingot that reduces the possibility of forming an alligator during rolling, thereby increasing metal yield during rolling. The shaped end formed by the bottom block tapers over the depth of the bottom block, which may be deeper than typical bottom blocks, and thereby reduce alligator shaped formations during rolling.

The bottom block designs included herewith may reduce butt swell in ingots without requiring intentionally slowing of the cast speed, thereby improving the quality of, and maintaining speed of cast ingot output and reducing ingot processing to account for butt swell. The bottom block described herein promotes heat removal from the bottom block that may result in reduced butt swell, increased solidification rate, and improved metallographic qualities.

The present description provides an overall understanding of the principles of the structure, function, manufacture, and use of the systems and methods disclosed herein. Several examples are illustrated in the accompanying drawings. Those of ordinary skill in the art will understand that the systems and methods specifically described herein and illustrated in the accompanying drawings are non-limiting embodiments. The features illustrated or described in connection with one embodiment may be combined with the features of other embodiments, including as between systems and methods. Such modifications and variations are intended to be included within the scope of the appended claims.

Additional details are described below with reference to several example embodiments.

FIGS. 1-4 illustrate a flared bottom block 100, according to the instant disclosure. The flared bottom block 100 includes an upper end 104 configured to fit within an existing DC casting mold, and has a height, for example in a range from two centimeters to fifty centimeters, that enables engagement with a DC casting mold. The lower end 106 is larger in cross sectional area than the upper end 104 which results in sloped sides 102. The sloped sides 102 provide a surface that extends outwards laterally from the sides of the bottom block 100, beyond the dimensions of the ingot cast by the mold. Such protrusions enable cooling fluid, which would normally not contact the bottom block due to film boiling and other thermal effects or casting conditions, to contact the bottom block and run down the sloped sides 102. The sloped sides 102 therefore provide a heat transfer surface for heat to be transferred from the bottom block 100 to the cooling fluid. In some examples, the sloped sides 102 may include or be replaced by other protrusions that extend beyond the cross section of the ingot and thereby contact cooling fluid. Such protrusions may include cooling fins, ridges, pyramids, and other such shapes or profiles that extend horizontally from the bottom block 100 and thereby increase a cross sectional surface area of a lower portion of the bottom block 100.

The bottom block 100 includes inner surfaces 208 that descend from the upper portion 104 towards a center of the bottom block, and thereby reduces the thickness of the ingot at the butt end that sits within the bottom block. The inner surfaces 208 provide for increased surface area contact with the butt of the cast ingot over typical bottom block designs and thereby increases heat transfer from the ingot to the bottom block 100. The bottom block 100 may therefore become a heat sink that aids in removal of heat from the ingot and thereby reduces butt swell of ingots during casting. The additional contact with the cooling fluid aids in removal of heat from the bottom block 100 due to the flared sides and thereby further removes heat from the butt end of the ingot.

In an embodiment, the bottom block 100 includes a ramped middle portion 314 and drain holes 316. The ramped middle portion 314 may aid with distribution of molten metal during a starting phase of a DC cast, as metal may be initially introduced within the bottom block at a center of the bottom block 100 and flow down the ramped middle portions 314 towards the ends (along a long axis) of the bottom block 100. The ramped middle portion 314 may also aid in positioning the butt of the ingot at the start of a cast along the centerline of the bottom block 100 so that the ingot does not shift later in the casting sequence and remains aligned to the center of the bottom block 100. The drain holes 316 may enable coolant or other material to flow out of the bottom block 100 and prevent interference with the molten metal at the start of the cast.

Figure 5:
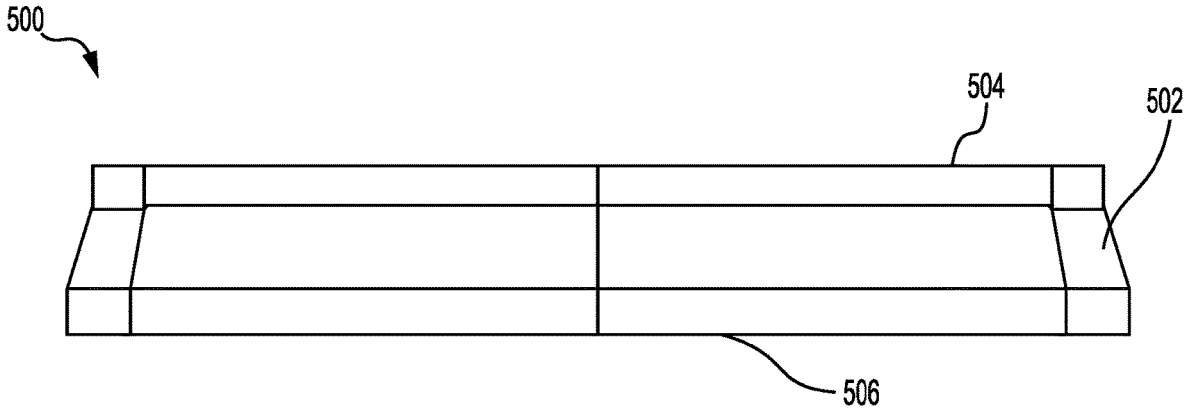
FIG. 5 illustrates a side view of a flared bottom block, according to at least one example.
Figure 6:
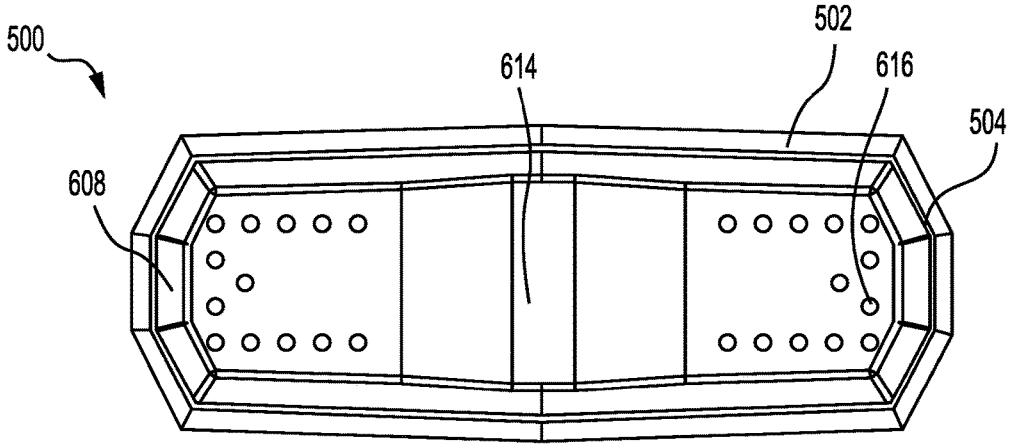
FIG. 6 illustrates a top view of the flared bottom block of FIG. 5, according to at least one example.
Figure 7:
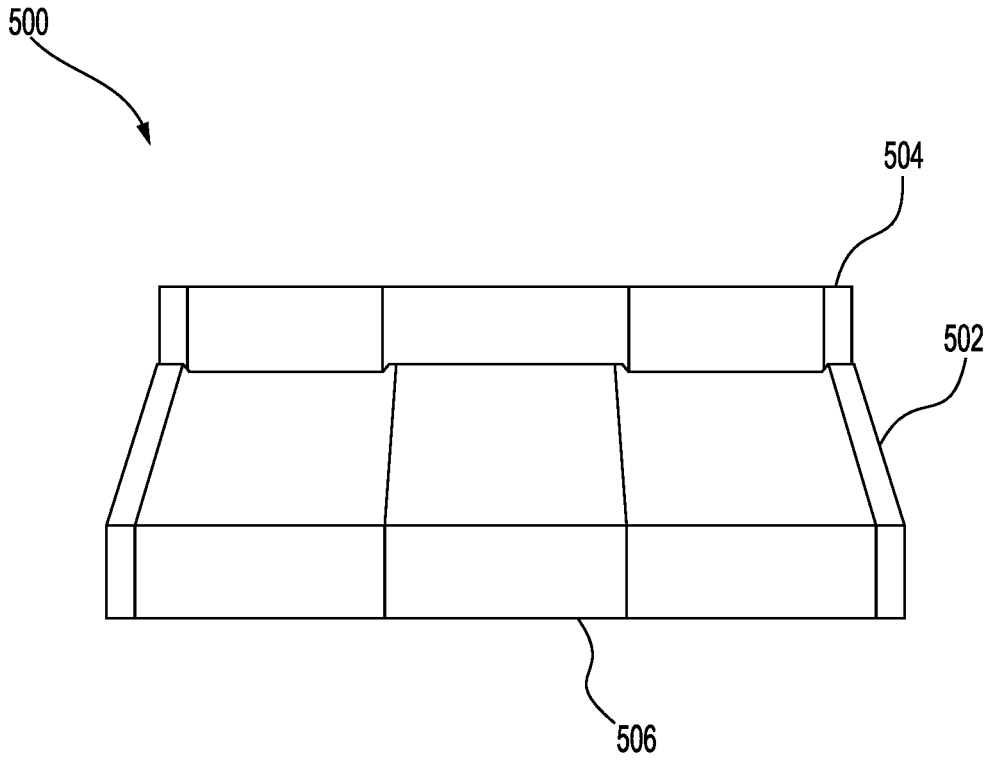
FIG. 7 illustrates an end view of the flared bottom block of FIG. 6, according to at least one example.

FIGS. 5-7 illustrate a flared bottom block 500, according to the present disclosure. The flared bottom block 500 may include similar features to the bottom block 100 of FIGS. 1-4. For example, an upper end 504 may have a first cross-sectional area less than a lower end 506 with sloped sides 502 that connect between the upper end 504 and the lower end 506. The flared bottom block 500 may also include a ramped middle portion 614 and drain holes 616 similar to the ramped middle portion 314 and drain holes 616 of FIGS. 1-4. The bottom block 500 may have a smaller height from the upper end 504 to the lower end 506 than the bottom block 100 and may be sized according to dimensions of existing bottom blocks to ensure compatibility with existing DC casting systems.

Figure 8:
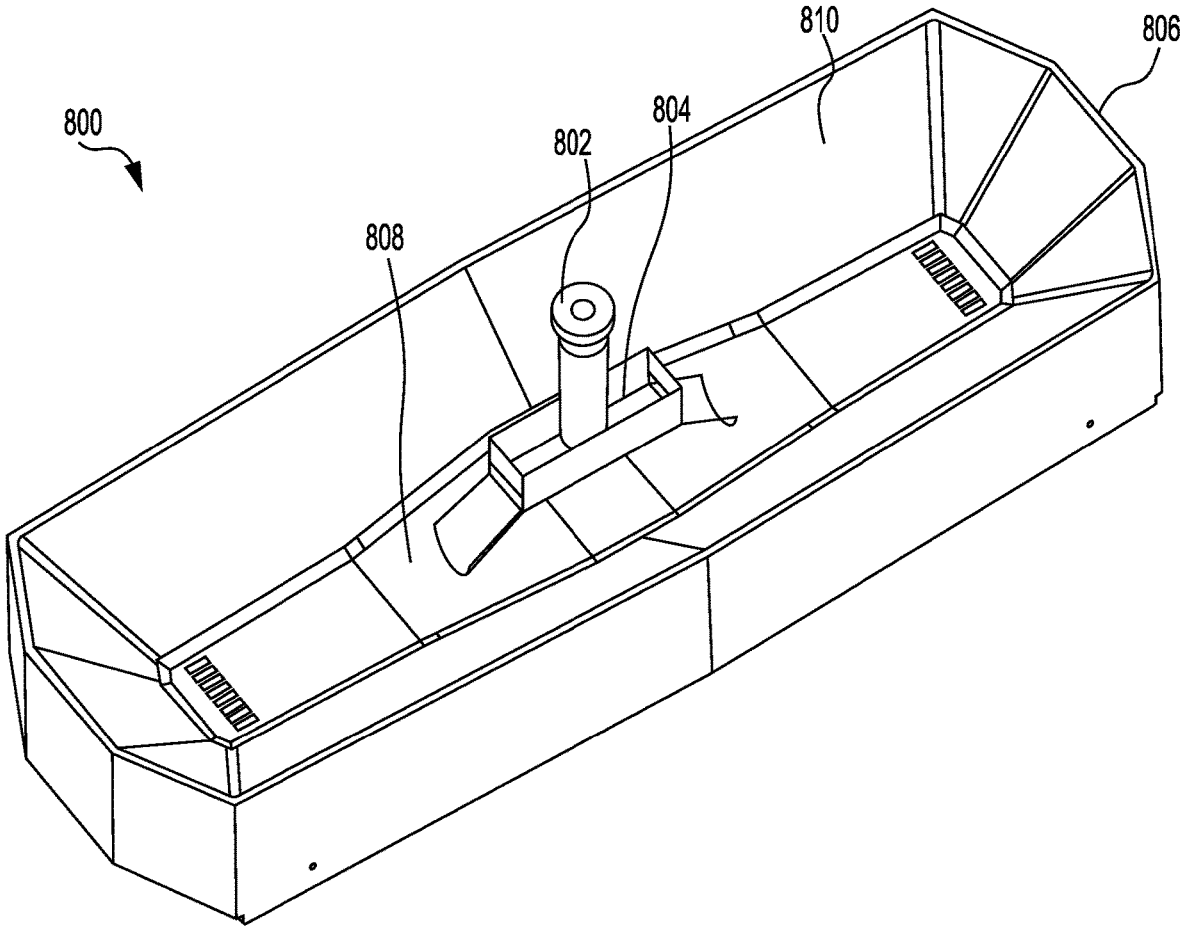
FIG. 8 illustrates a perspective view of a bottom block having ramped inner walls, according to at least one example.
Figure 9:
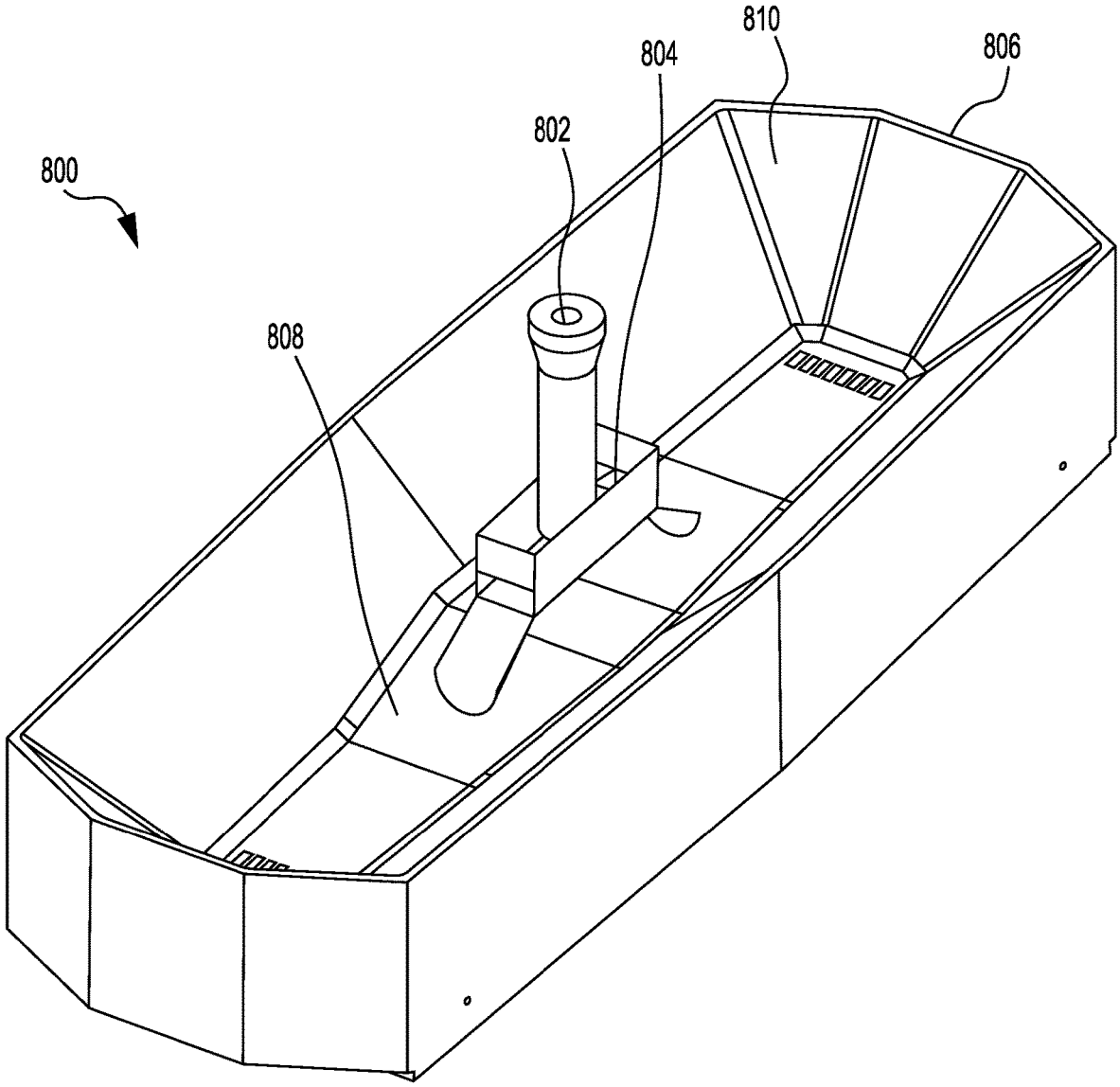
FIG. 9 illustrates a perspective view of a bottom block having ramped inner walls, according to at least one example.

FIGS. 8-9 illustrate a bottom block 800 having ramped inner walls 810, according to the present disclosure. The bottom block 800 is fed, during DC casting, by a spout 802 and distribution device 804 that may direct molten metal from the spout 802 along a lengthwise axis of the bottom block 800 away from the spout 802. The ramped middle portion 808, which may be similar to the ramped middle portion 314 of FIGS. 1-4, may work in conjunction with the distribution device 804 to guide molten metal evenly around the bottom block 800. The ramped middle portion 808 may also improve molten metal distribution within the bottom block 800 without inducing turbulent flow. The ramped middle portion 808 includes inclined surfaces that enhance laminar flow of metal is the molten metal flows away from the spout 802 towards the edges of the bottom block 800.

The ramped inner walls 810 descend from the upper perimeter 806 towards a center of the bottom block, and thereby reduces the thickness of the ingot at the butt end that sits within the bottom block. The ramped inner walls may extend a distance of around one half the distance from a top of the bottom block to a bottom of the bottom block. In some examples, the ramped inner walls may extend more or less than half the distance from the top to the bottom of the bottom block, forming a deep cavity for receiving molten metal. The ramped inner walls 810 provide for increased surface area contact with the butt of the cast ingot and thereby increases heat transfer from the ingot to the bottom block 800. The bottom block 800 may therefore become a heat sink that aids in removal of heat from the ingot and thereby reduces butt swell of ingots during casting.

Figure 10:
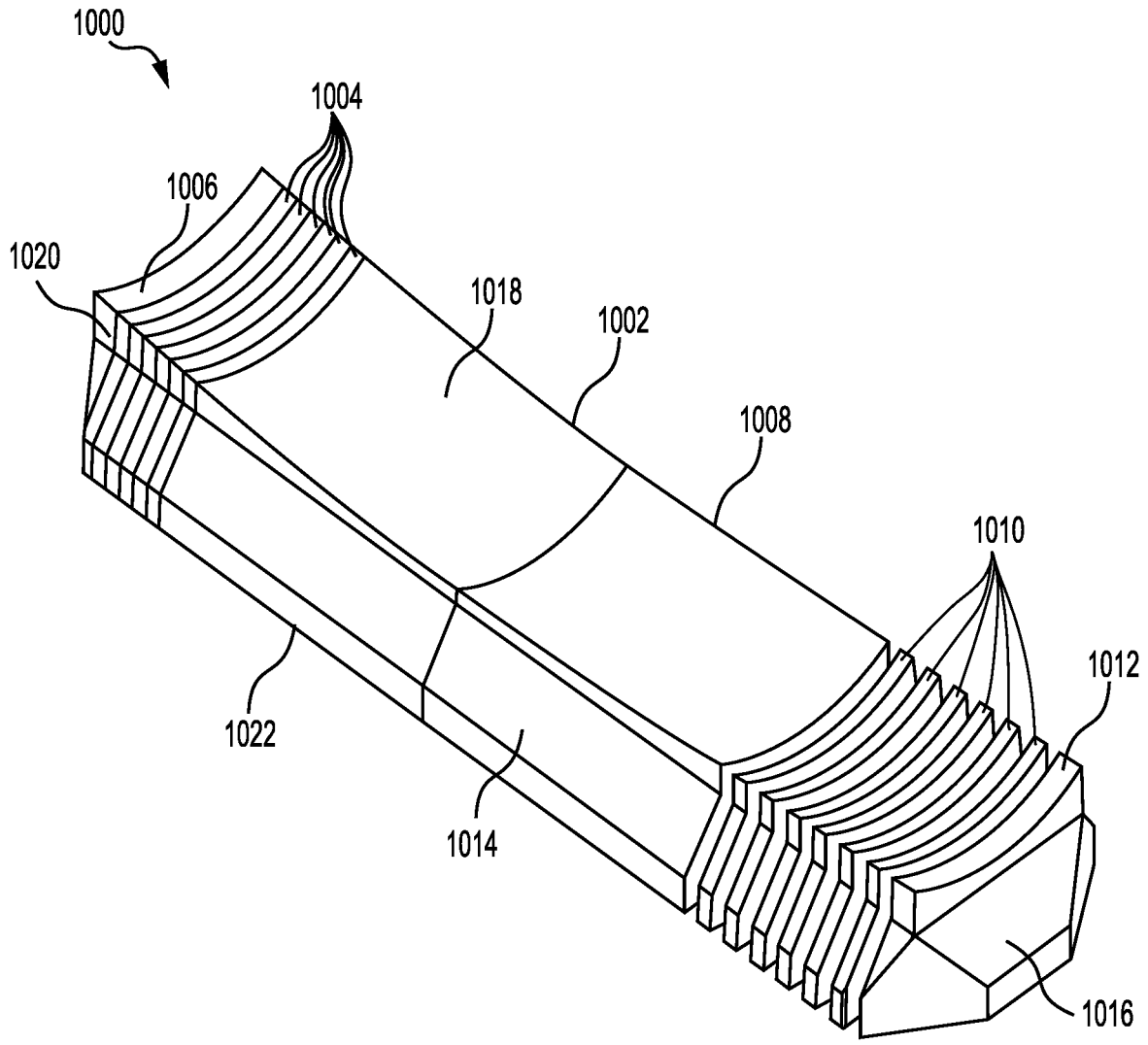
FIG. 10 illustrates a perspective view of a bottom block having removable segments for configurable lengths, according to at least one example.
Figure 11:
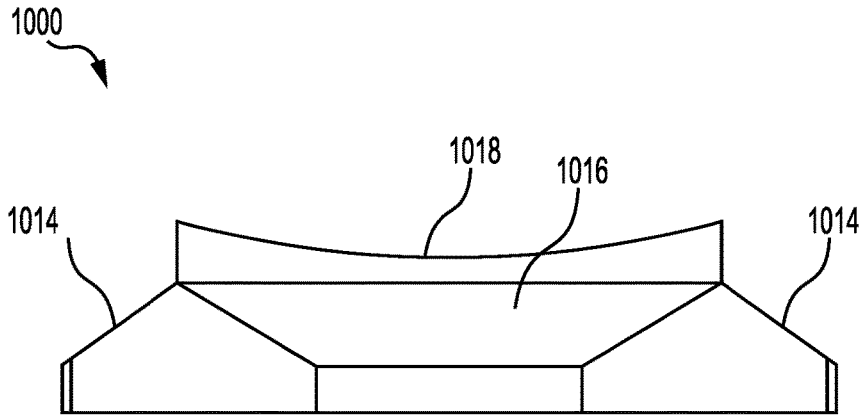
FIG. 11 illustrates an end view of the bottom block of FIG. 10, according to at least one example.
Figure 12:
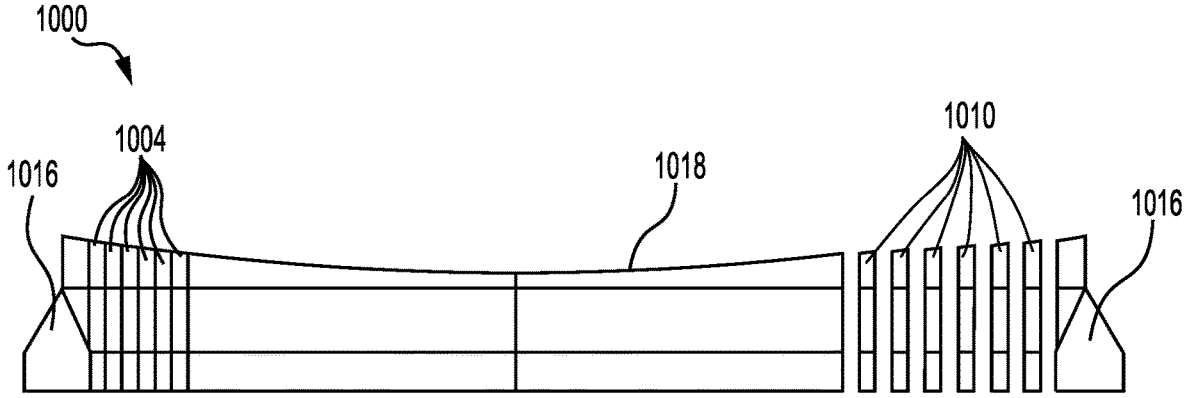
FIG. 12 illustrates a side view of the bottom block of FIG. 10, according to at least one example.

FIGS. 10-12 illustrate a bottom block 1000 having removable segments 1004 and 1010 for configurable lengths, according to at least one example. The flared bottom block 1000 may include similar features to the bottom block 100 of FIGS. 1-4 and/or other examples described herein. For example, an upper end 1018 may have a first cross-sectional area less than a lower end 1022 with sloped sides 1014 that connect between the upper end 1018 and the lower end 1014. The upper end 1018 may be defined by perimeter walls 1020 that may interface with a mold body at the start of a casting procedure before being lowered out of the mold. The bottom block 1000 may also include drain holes, ramps, and other features similar to other examples described herein. The profile of the bottom block 1000 is designed with a shallow upper region that interfaces with a mold body, at the top end 1018. The ends 1006 and 1012 also include ramped portions similar to the sloped sides 1014.

The removable segments 1004 and 1010 may be selectively removable to create varying widths of bottom blocks, for example to fit within particular mold sizes for rolling mills or other processing machinery that may require particular dimensions of metal products. The removable segments couple to middle portions 1002 and 1008 as well as to ends 1006 and 1012. The middle portions 1002 and 1008 are shown forming a shallow cavity, though other types of bottom block designs may be implemented, such as described herein. The middle portions 1002 and 1008 may couple together using a fastener or other semi-permanent or removable attachment. In some examples, the middle portions 100 and 1008 may be permanently joined together.

The removable segments 1004 and 1010 are similarly removable and insertable between the middle portions 1002 and 1008 and the ends 1006 and 1012. Different numbers of removable sections may be used to adjust the width of the bottom block 1000. In some examples, asymmetric bottom blocks may be designed by incorporating different numbers of removable sections 1004 and 1010. In some examples, the removable segments 1004 and 1010 may have thicknesses of one inch or less, but in some examples may also have a thickness of greater than one inch, depending on a particular implementation. The removable segments 1004 and 1010 may be coupled together, with the bottom block 1000 assembled using fasteners such as bolts along the length of the bottom block 1000 to hold the removable segments 1010 to the middle portion 1008, with the bolts running through the end 1012 to hold the end 1012 in place. The fasteners and/or pins or other alignment features may be used to ensure proper alignment of the segments for the bottom block 1000.

Figure 13:
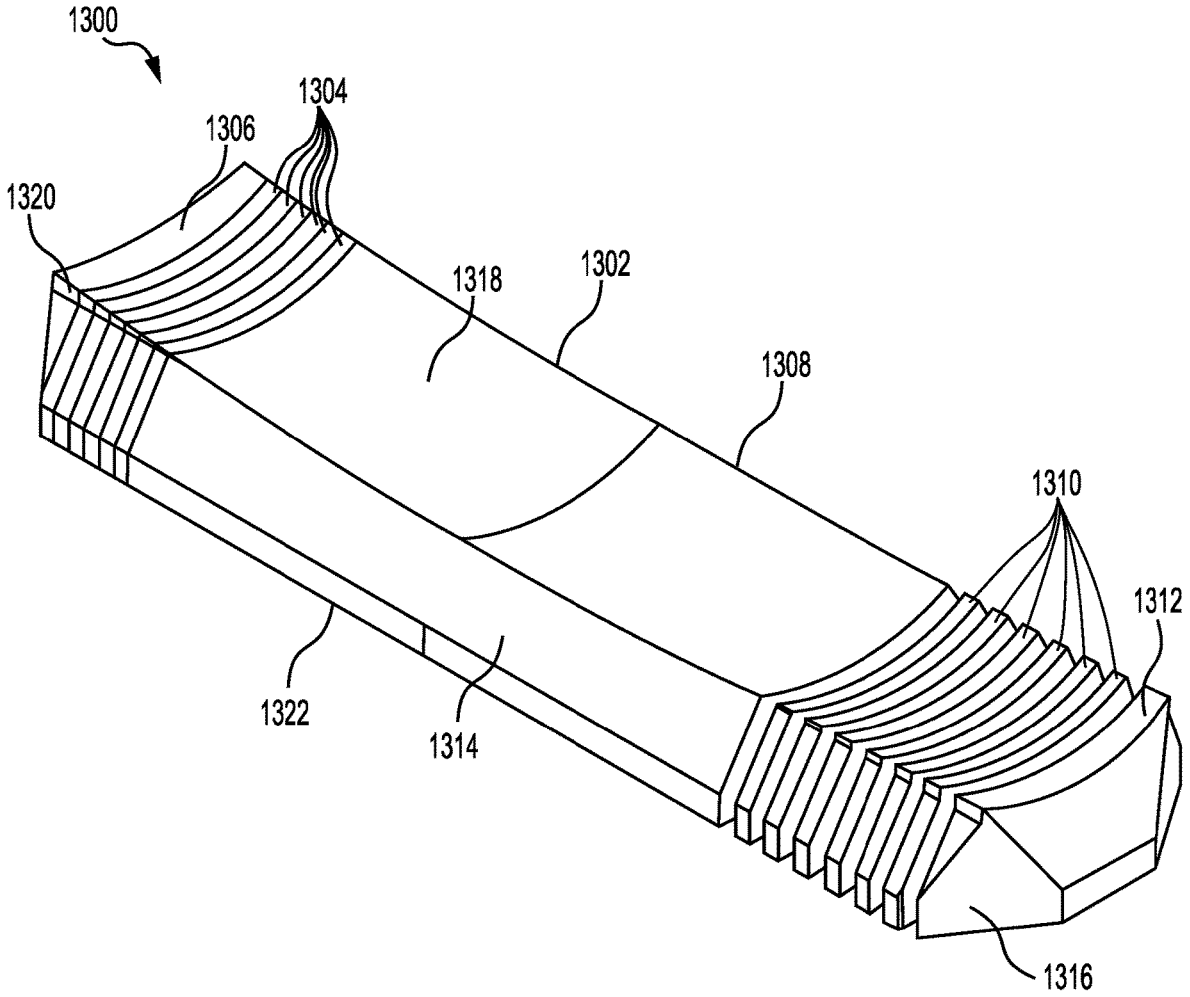
FIG. 13 illustrates a perspective view of a bottom block having removable segments for configurable lengths, according to at least one example.
Figure 14:
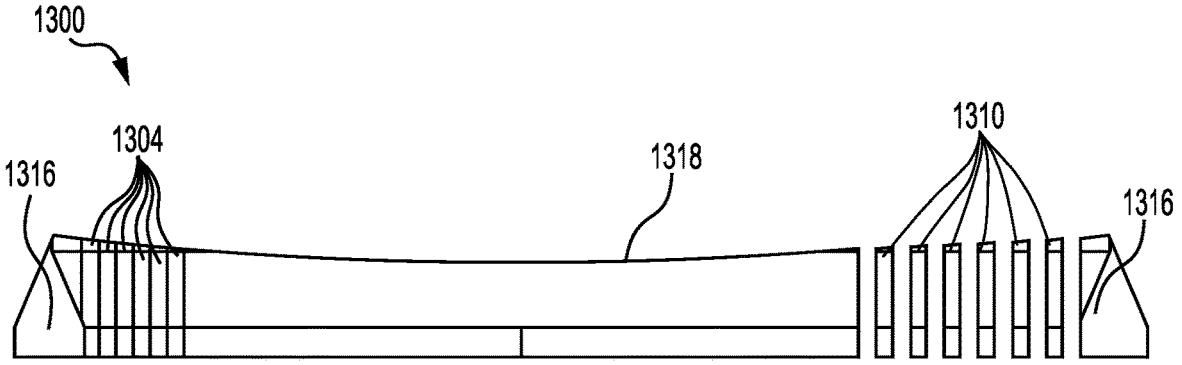
FIG. 14 illustrates a side view of the bottom block of FIG. 13, according to at least one example.
Figure 15:
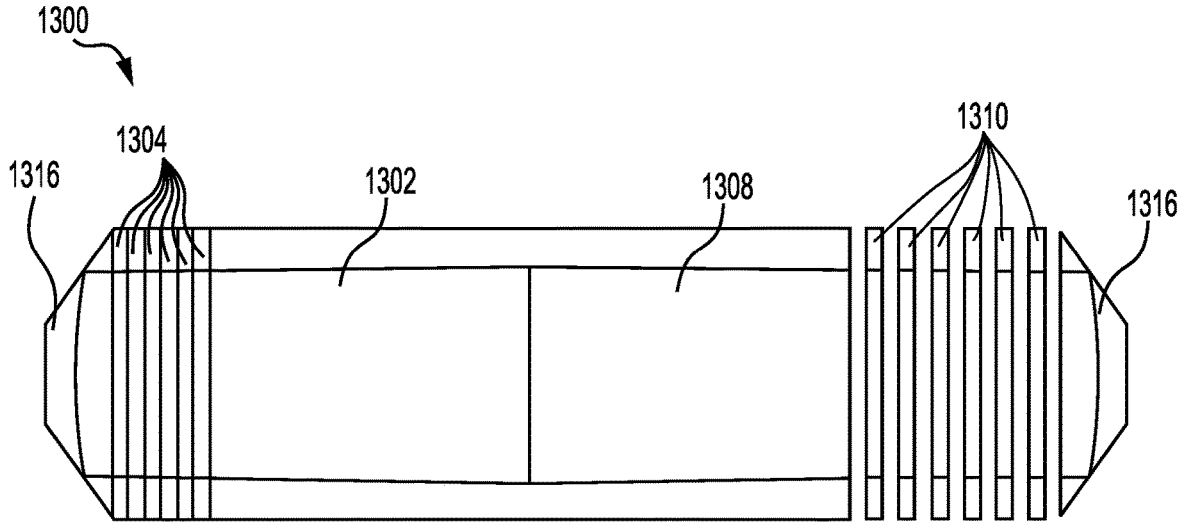
FIG. 15. illustrates a top view of the bottom block of FIG. 13, according to at least one example.

FIGS. 13-15 illustrate a bottom block 1300 having removable segments for configurable lengths, according to at least one example. The bottom block 1300 is shown with similar features to those described with respect to bottom block 1000, including the middle portions 1302 and 1308, removable segments 1304 and 1310, ends 1306 and 1312, top end 1318, bottom end 1322, and sloped sides 1314 and 1316. The bottom block 1300 is shown with the perimeter walls 1320 having a height less than the height of the perimeter walls 1022. The different heights between the bottom block 1000 and the bottom block 1300 may enable the bottom block 1000 to act as a heat sink for a larger capacity of heat energy due to the larger mass of the bottom block 1000. However, the bottom block 1300 with the sloped sides 1314 and 1316 may also feature increased heat transfer to cooling fluid over typical bottom blocks and therefore may provide the benefits described herein.

Figure 16:
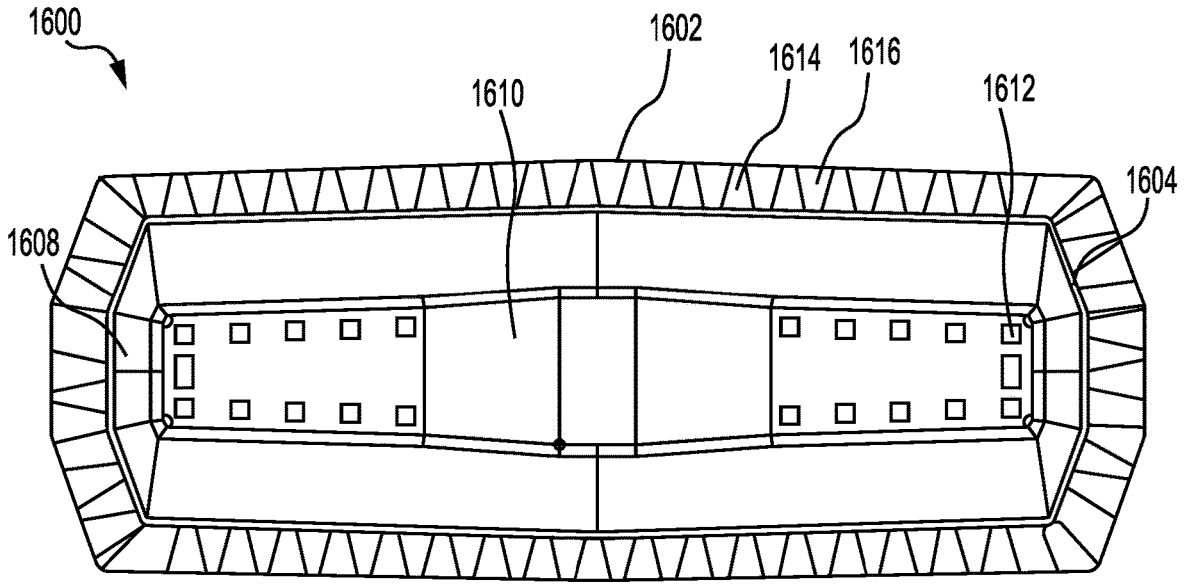
FIG. 16 illustrates a top view of a bottom block including a scalloped edge wall, according to at least one example.
Figure 17:
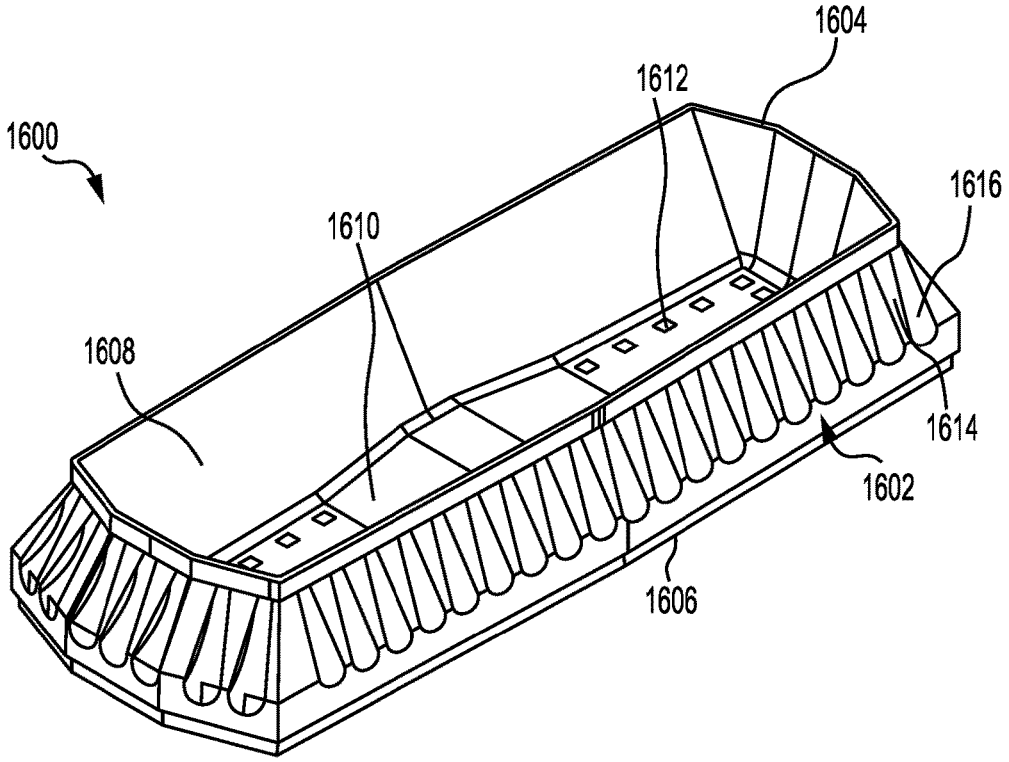
FIG. 17 illustrates a perspective view of the bottom block of FIG. 16, according to at least one example.

FIGS. 16-17 illustrate a bottom block 1600 including a scalloped perimeter wall, according to at least one example. The bottom block 1600 may be similar to the bottom block 100 and/or bottom block 800, or other examples described herein. The bottom block 1600 therefore includes a top end 1604 defining a region area with a smaller cross-sectional area than a bottom end 1606, with the external walls 1602 and internal walls 1608 sloped to taper from a narrower width at the top end 1604 to a greater width at the bottom end 1606. The bottom block 1600 also includes ramps 1610 and drain holed 1612 similar to those described above.

The external walls 1602 include cooling features configured to provide greater surface area for heat exchange with an environment and/or to a cooling fluid. In the illustrated example, the cooling features includes scalloped edges 1616 with raised portions 1614 between the scalloped edges 1616. The scalloped edges 1616 provide for greater surface area and are shown having rounded and/or arced profiles, though other profiles are contemplated that would enable additional cooling through contact with fluids, such as a coolant as well as the surrounding air. The scalloped edges 1616 may have a conical or frusto-conical shape in some examples. For example, the cooling features may include fins or other such heat dissipating elements. In the illustrated example, the scalloped edges 1616 overcome a typical difficulty with adding such features to bottom blocks, longevity and strength requirements for the extreme temperatures and environments of casting. The scalloped edges may be machined to remove material in selected regions and thereby do not create delicate or fragile fins as typical heat exchangers would. Instead, the scalloped edges 1616 provide additional surface area as well as channeling of coolant into directed streams. In some examples, the scallops may direct the coolant to particular destinations, such as for circulation within the bottom block. In an example, the scalloped edges 1616 may funnel coolant into a passageway that passes through the bottom block before draining out the bottom end of the bottom block 1600. In such examples, the bottom block may be integrally cooled without requiring separate coolant lines to be connected to the bottom block 1600.

The following describe examples that may be implemented, including examples that may be combined in various example embodiments.

A. A bottom block for direct chill (DC) casting, comprising: a monolithic block defined by: an upper portion configured to interface with a DC casting mold; a lower portion having a cross-sectional area that is less than a cross sectional area defined by a perimeter of the upper portion; an external surface that tapers from the upper portion to the lower portion, the external surface having a slope that increases a width of the monolithic block as the external surface extends from the upper portion to the lower portion, wherein the external surface is configured to receive cooling fluid from a DC casting apparatus, the slope of the external surface configured to maintain the cooling fluid in contact along a height of the external surface; and an interior surface configured to receive molten metal for solidification.

B. The bottom block of paragraph A, wherein the upper portion comprises a vertical surface to interface with the DC casting mold and wherein the external surface comprises a sloped portion adjacent the upper portion.

C. The bottom block of paragraph A, wherein the external surface comprises one or more protrusions extending horizontally from the bottom block.

D. The bottom block of paragraph A, wherein the interior surface comprises a central portion and a peripheral portion, the central portion at a first height and the peripheral portion at a second height, the first height greater than the second height.

E. A bottom block for DC casting, comprising: an upper portion configured to interface with a DC casting mold; a lower portion configured to be supported by a DC casting apparatus for displacing the bottom block during casting; an inner wall having a first slope extending from the upper portion towards a center of the bottom block; and an inner surface that, together with the inner wall, defines a cavity of the bottom block for receiving molten metal, the inner surface comprising a central portion and a peripheral portion, the central portion at a first height and the peripheral portion at a second height, the first height greater than the second height.

F. The bottom block of paragraph E, wherein the inner wall extends at least half of a distance between the upper portion and the lower portion.

G. The bottom block of paragraph E, further comprising an external wall comprising one or more protrusions extending away from a center of the bottom block and configured to interface with cooling liquid during casting to cool the bottom block.

H. A bottom block for DC casting, comprising: an upper surface defining a receiving volume configured to receive molten metal during casting; a first end along a first direction; a second end along a second direction opposite the first direction; and one or more removable segments configured to change a length of the bottom block in response to the one or more removable segments being inserted or removed from the bottom block, the one or more removable segments configured to be inserted perpendicular to the first direction between the first end and the second end.

I. The bottom block of paragraph H, wherein the bottom block comprises a first portion and a second portion, the first portion comprising the first end and the first portion and the second portion releasably secured together such that the one or more removable segments are insertable between the first portion and the second portion.

J. The bottom block of paragraph H, further comprising one or more protrusions from an external surface of the bottom block configured to extend horizontally beyond a perimeter of the upper surface.

K. The bottom block of paragraph H, wherein the one or more removable segments comprise a surface configured to interface with the upper surface to produce a continuous profile.

L. A bottom block for DC casting, comprising: an upper portion configured to interface with a DC casting mold; a lower portion having a cross-sectional area that is less than a cross sectional area defined by a perimeter of the upper portion; an external surface that tapers from the upper portion to the lower portion, the external surface having a slope that increases a width of the bottom block as the external surface extends from the upper portion to the lower portion, wherein the external surface is configured to receive cooling fluid from a DC casting apparatus, the slope of the external surface configured to maintain the cooling fluid in contact along a height of the external surface, wherein the external surface includes one or more protrusions extending horizontally from the bottom block; and an interior surface configured to receive molten metal for solidification.

M. The bottom block of paragraph L, wherein the one or more protrusions define channels extending at least a portion of a distance from the upper portion to the lower portion.

N. The bottom block of paragraph L, wherein the protrusions comprise scalloped edges.

O. The bottom block of paragraph L, wherein the interior surface comprises an inner wall having a first slope extending from the upper portion towards a center of the bottom block.

While the foregoing invention is described with respect to the specific examples, it is to be understood that the scope of the invention is not limited to these specific examples. Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Although the application describes embodiments having specific structural features and/or methodological acts, it is to be understood that the claims are not necessarily limited to the specific features or acts described. Rather, the specific features and acts are merely illustrative some embodiments that fall within the scope of the claims.

What is claimed is:

1. A bottom block for direct chill (DC) casting, comprising:

a monolithic block defined by:

an upper portion configured to interface with a DC casting mold;

a lower portion having a cross-sectional area that is larger than a cross sectional area defined by a perimeter of the upper portion;

an external surface that tapers from the upper portion to the lower portion, the external surface having a slope that increases a width of the monolithic block as the external surface extends from the upper portion to the lower portion, wherein the external surface is configured to receive cooling fluid from a DC casting apparatus, the slope of the external surface configured to maintain the cooling fluid in contact along a height of the external surface; and an interior surface configured to receive molten metal for solidification wherein the external surface comprises one or more protrusions extending horizontally from the bottom block.

2. The bottom block of claim 1, wherein the upper portion comprises a vertical surface to interface with the DC casting mold and wherein the external surface comprises a sloped portion adjacent the upper portion.

3. The bottom block of claim 1, wherein the interior surface comprises a central portion and a peripheral portion, the central portion at a first height and the peripheral portion at a second height, the first height greater than the second height.

* * * * *